US009776240B2

(12) United States Patent
Jia et al.

(10) Patent No.: US 9,776,240 B2
(45) Date of Patent: Oct. 3, 2017

(54) HUB DIE-CASTING MOULD

(71) Applicant: SIYANG MINGYUXING PRECISION MACHINERY CO., LTD, Suqian (CN)

(72) Inventors: Minshuan Jia, Suqian (CN); Xingxiang Tan, Suqian (CN); Guoxing Xu, Suqian (CN)

(73) Assignee: SIYANG MINGYUXING PRECISION MACHINERY CO., LTD, Suqian (CN)

( * ) Notice: Subject to any disclaimer, the term of this patent is extended or adjusted under 35 U.S.C. 154(b) by 0 days.

(21) Appl. No.: 15/310,918

(22) PCT Filed: Apr. 10, 2015

(86) PCT No.: PCT/CN2015/076233

§ 371 (c)(1),
(2) Date: Nov. 14, 2016

(87) PCT Pub. No.: WO2016/127487

PCT Pub. Date: Aug. 18, 2016

(65) Prior Publication Data

US 2017/0080487 A1 Mar. 23, 2017

(30) Foreign Application Priority Data

Feb. 11, 2015 (CN) ..... 2015 1 0070964

(51) Int. Cl.

| | |
|---|---|
| ***B22C 9/06*** | (2006.01) |
| ***B22C 9/28*** | (2006.01) |
| ***B22D 25/02*** | (2006.01) |
| ***B22D 17/22*** | (2006.01) |
| ***B22D 18/04*** | (2006.01) |

(52) U.S. Cl.

CPC ..... *B22D 17/22* (2013.01); *B22C 9/06* (2013.01); *B22C 9/28* (2013.01); *B22D 18/04* (2013.01); *B22D 25/02* (2013.01)

(58) Field of Classification Search

CPC .. B22C 9/06; B22C 9/28; B22D 17/22; B22D 18/04; B22D 25/02

USPC ..... 164/137, 339, 341–343

See application file for complete search history.

(56) References Cited

U.S. PATENT DOCUMENTS 4,492,264 A * 1/1985 Gaddi ..... B22D 13/04 164/292

FOREIGN PATENT DOCUMENTS

CN 104325091 A * 2/2015
JP WO 2009072222 A1 * 6/2009 ..... B22D 17/007

* cited by examiner

*Primary Examiner* — Kevin E Yoon
(74) *Attorney, Agent, or Firm* — CBM PATENT CONSULTING, LLC

(57) ABSTRACT

A hub die-casting mold comprises a lower mold, a side mold, and an upper mold that are combined to form a hub casting cavity, where the lower mold is disposed on a lower mold plate, and the side mold is formed by abutting four sections of arc portions which are slidably connected to the lower mold plate, where the four sections of arc portions are divided into two groups that are respectively located at the left and right sides of the lower mold, and included angles from 3° to 10° are set between sliding tracks of two sections of arc portions in each group and a left-right diameter of the lower mold.

7 Claims, 3 Drawing Sheets

HUB DIE-CASTING MOULD

This application is the U.S. national phase of International Application No. PCT/CN2015/076233 filed on 10 Apr. 2015 which designated the U.S. and claims priority to Chinese Application Nos. CN201510070964.8 filed on 11 Feb. 2015, the entire contents of each of which are hereby incorporated by reference.

BACKGROUND

Technical Field

The present invention relates to the field of hub casting, and specifically, to a hub die-casting mold.

Related Art

A hub is a component used to connect a tire and a shaft of a vehicle. Manufacturing technologies may include an integral casting type, an integral forging type, and a compound type. Integrally cast hubs take up about 90% of a total production volume of hubs by virtue of an advantage of low costs. A manufacturing process of an integrally cast hub is casting molten aluminum, that is, liquid aluminum alloy, into a cavity of a mold, performing demolding and cooling after the molten aluminum is solidified to form a hub blank, and then performing fine processing such as deburring, polishing, and surface processing to obtain a finished hub. According to different technologies for casting the molten aluminum, gravity casting and pressure casting are included. A structure of a hub is a cylinder including a rim and spokes. To facilitate demolding, for a casting mold of the hub, an upper mold, a lower mold, and a side mold are generally used to form a hub casting cavity. For the pressure casting, pressure needs to be maintained after the molten aluminum is cast into the mold. Better air-tightness of the cavity indicates a higher pressure resistance value, and better quality of the cast hub. Vertical columns are respectively disposed at four angles of a lower mold plate of a present pressure casting mold. Four sections of arc portions which form the side mold are respectively connected to sliding slots on the vertical columns by using sliding blocks. During casting, pressure is continuously exerted on exterior walls of the four sections of the arc portions respectively by using four oppositely disposed oil cylinders, so as to avoid air holes. High energy consumption of the oil cylinders also increases manufacturing costs of the hub. In addition, the pressure resistance value of the cavity is limited by specifications of the oil cylinders, and pressure in the cavity acts on the vertical columns by using the side mold. To prevent the vertical columns from deformation, not only the upper mold is connected to an ejection rod plate, but also an upper mold plate which is connected to top ends of the vertical columns and has a size nearly equal to that of the lower mold plate is further disposed on the upper mold. A complete set of mold has a lot of components, and a structure is complex.

SUMMARY

A technical problem to be solved by the present invention is to provide a hub die-casting mold, so as to solve the problem that in an existing hub die-casting mold, four oil cylinders are respectively used to drive four sections of arc portions forming a side mold and are used to exert pressure on the four sections of arc portions, leading to high energy consumption and an increase in manufacturing costs of a hub.

The present invention is implemented by means of the following technical solutions:

A hub die-casting mold includes a lower mold, a side mold, and an upper mold that are combined to form a hub casting cavity, where the lower mold is disposed on a lower mold plate, and the side mold is formed by abutting four sections of arc portions which are slidably connected to the lower mold plate, where the four sections of arc portions are divided into two groups that are respectively located at the left and right sides of the lower mold, and included angles from 3° to 10° are set between sliding tracks of two sections of arc portions in each group and a left-right diameter of the lower mold; and further includes two connecting blocks that are respectively disposed on outer sides of the two groups of arc portions, where the connecting blocks are provided with connecting holes, hooks are respectively disposed on exterior walls of the two sections of arc portions in each group, and the hooks are slidably connected to the connecting holes.

A further solution of the present invention is: the lower mold plate is respectively provided with sliding slots at two sides of the left-right diameter of the lower mold; and a sliding block fitting with the sliding slot is disposed at a bottom portion of each section of arc portion.

A further solution of the present invention is: each connecting block is provided with two connecting holes; and the hooks at the exterior walls of the two sections of arc portions in each group are slidably connected to the two connecting holes, respectively.

A further solution of the present invention is: the hook is formed by a connecting plate which is connected to an exterior wall of an abutting end of two arc portions and a vertical column that is fixed at an upper surface of the connecting plate; and the vertical column runs through the connecting hole.

A further improved solution of the present invention is: the exterior wall of the side mold is a truncated cone of which one end is large and the other end is small; the exterior wall of the side mold is connected to an annular mold locking sleeve; an inner diameter of the mold locking sleeve is between an outer diameter of the large end and an outer diameter of the small end of the exterior wall of the side mold; and an inner wall of the mold locking sleeve has a conical degree same as that of the exterior wall of the side mold.

A still further solution of the present invention is: the conical degree of the exterior wall of the side mold is from 8° to 12°.

A yet further solution of the present invention is: an axial length of the mold locking sleeve is ⅓ to ½ of a height of the side mold.

Compared with the prior art, the present invention has the following advantages:

1. Two sections of arc portions in one group are pulled separately by using two connecting blocks, and the two connecting blocks need to be driven by only two oil cylinders, thereby halving energy consumption of oil cylinders in a casting process, and significantly reducing manufacturing costs of a hub.

2. Cavity pressure is provided by using a mold locking sleeve, removing limitations of specifications of the oil cylinders. In this way, the oil cylinders driving the connecting blocks need to provide a power for moving only the arc portions, so as to reduce the manufacturing costs of the hub, effectively improve a pressure resistance value of a cavity, and improve crystallinity and density of the hub. A hub manufactured by using molten aluminum of an equal weight has higher strength than an existing hub. Weights of molten aluminum needed by hubs having same strength are reduced by about 10%, thereby effectively improving market competitiveness of the hub and a mold.

3. Cavity pressure is provided by using a mold locking sleeve, saving vertical columns and an upper mold plate, thereby reducing components of the mold and simplifying a structure of the mold.

4. Compared with existing pressure casting in which various factors, such as mold clamping and demolding, need to be considered, in the present invention, professional operation requirements are high, steps for mold clamping and demolding are simplified, and a foolproof operation is implemented.

DETAILED DESCRIPTION

Figure 1:
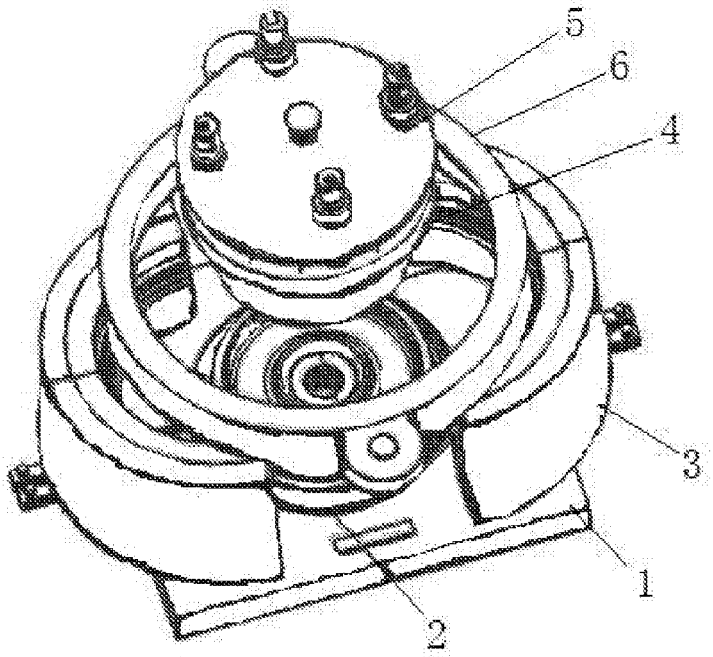
FIG. 1 is a schematic diagram of a mold opening state according to the present invention.
Figure 2:
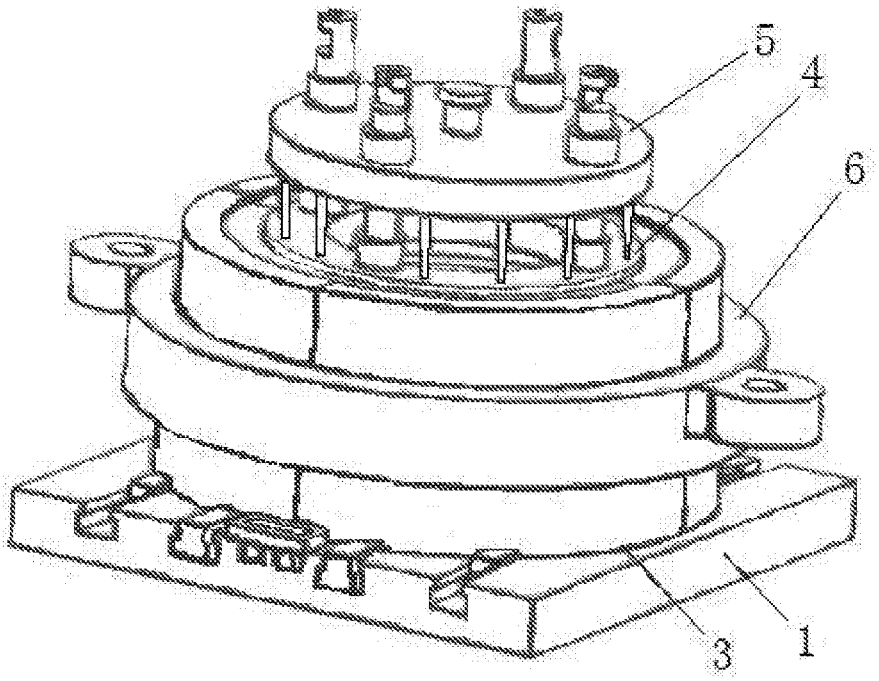
FIG. 2 is a schematic diagram of a mold clamping state according to the present invention.
Figure 3:
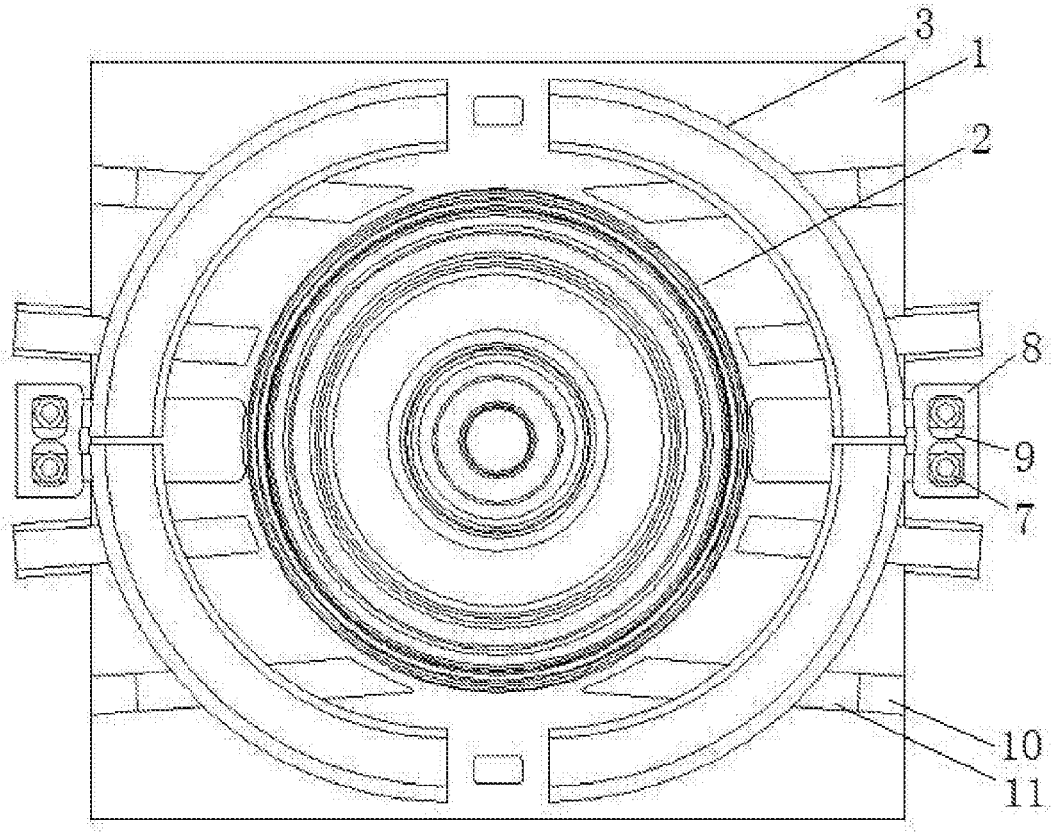
FIG. 3 is a schematic diagram of a connection structure between arc portions and a lower mold plate.

A hub die-casting mold shown in FIG. 1, FIG. 2, and FIG. 3 includes a lower mold 2, a side mold, and an upper mold 4 that are combined to form a hub casting cavity. An upper end of the upper mold 4 is connected to an ejection rod plate 5. The lower mold 2 is disposed on a lower mold plate 1. An exterior wall of the side mold is a truncated cone that has a conical degree from 8° to 12° and of which one end is large and the other end is small. The exterior wall of the side mold is connected to an annular mold locking sleeve 6 whose an axial length is ⅓ to ½ of a height of the side mold. An inner diameter of the mold locking sleeve 6 is between an outer diameter of the large end and an outer diameter of the small end of the exterior wall of the side mold; and an inner wall of the side mold has a conical degree same as that of the exterior wall of the side mold.

The side mold is formed by abutting four sections of arc portions 3 which are slidably connected to the lower mold plate 1. The four sections of arc portions 3 are divided into two groups that are respectively located at the left and right sides of the lower mold 2. The lower mold plate 1 is symmetrically provided with sliding slots 10 at two sides of a left-right diameter of the lower mold 2, where included angles between the sliding slots and the left-right diameter are from 3° to 10°. A sliding block 11 fitting with the sliding slot 10 is disposed at a bottom portion of each section of arc portion 3. The hub die-casting mold further includes two connecting blocks 8 that are respectively disposed on outer sides of the two groups of arc portions. The connecting blocks 8 are provided with two slotted connecting holes 9. Hooks 7 are respectively disposed on exterior walls of two sections of arc portions 3 in each group. The hooks 7 are formed by a connecting plate which is connected to an exterior wall of an abutting end of two arc portions 3 and a vertical column that is fixed at an upper surface of the connecting plate. The vertical column runs through the connecting hole 9.

Horizontal oil cylinders which drive the connecting blocks 8 push the arc portions 3 to move along inclined sliding slots to abut with each other. Vertical oil cylinders drive the mold locking sleeve 6 lower, to be sleeved at the exterior wall of the side mold, so as to achieve locking. Then, the upper mold 4 moves downward to implement mold clamping. A part of acting force exerted by the cavity on the side mold is used to overcome a friction force between the mold locking sleeve 6 and the side mold, and the other part is directly exerted on the mold locking sleeve 6. Therefore, specifications of the horizontal oil cylinders and the vertical oil cylinders are both significantly decreased. When demolding is performed, the upper mold 4 and the mold locking sleeve 6 are first lifted sequentially, and then the side mold is opened.

What is claimed is:

1. A hub die-casting mold, comprising a lower mold (2), a side mold, and an upper mold (4) that are combined to form a hub casting cavity, wherein the lower mold (2) is disposed on a lower mold plate (1), and the side mold is formed by abutting four sections of arc portions (3) which are slidably connected to the lower mold plate (1), wherein the four sections of arc portions (3) are divided into two groups that are respectively located at the left and right sides of the lower mold (2), included angles from 3° to 10° are set between sliding tracks of two sections of arc portions (3) in each group and a left-right diameter of the lower mold (2); and further comprising two connecting blocks (8) that are respectively disposed on outer sides of the two groups of arc portions, wherein the connecting blocks (8) are provided with connecting holes (9), hooks (7) are respectively disposed on exterior walls of the two sections of arc portions (3) in each group, and the hooks (7) are slidably connected to the connecting holes (9).

2. The hub die-casting mold according to claim 1, wherein the lower mold plate (1) is respectively provided with sliding slots (10) at two sides of the left-right diameter of the lower mold (2); and a sliding block (11) fitting with the sliding slot (10) is disposed at a bottom portion of each section of arc portion (3).

3. The hub die-casting mold according to claim 1, wherein each connecting block (8) is provided with two connecting holes (9); and the hooks (7) at the exterior walls of the two sections of arc portions (3) in each group are slidably connected to the two connecting holes (9), respectively.

4. The hub die-casting mold according to claim 3, wherein the hook (7) is formed by a connecting plate which is connected to an exterior wall of an abutting end of two arc portions (3) and a vertical column that is fixed on an upper surface of the connecting plate; and the vertical column runs through the connecting hole (9).

5. The hub die-casting mold according to claim 1, wherein the exterior wall of the side mold is a truncated cone of which one end is large and the other end is small; the exterior wall of the side mold is connected to an annular mold locking sleeve (6); an inner diameter of the mold locking sleeve (6) is between an outer diameter of the large end and an outer diameter of the small end of the exterior wall of the side mold; and an inner wall of the mold locking sleeve (6) has a conical degree same as that of the exterior wall of the side mold.

6. The hub die-casting mold according to claim 5, wherein the conical degree of the exterior wall of the side mold is from 8° to 12°.

7. The hub die-casting mold according to claim 5, wherein an axial length of the mold locking sleeve (6) is ⅓ to ½ of a height of the side mold.

* * * * *